US010704271B2

(12) United States Patent
Bunch et al.

(10) Patent No.: US 10,704,271 B2
(45) **Date of Patent: *Jul. 7, 2020**

(54) WEDGE DEVICE FOR LEVELING TILES AND CLIP SET FOR USE OF SAME

(71) Applicants: Clinton D. Bunch, Keller, TX (US); Joshua A. Bunch, Keller, TX (US)

(72) Inventors: Clinton D. Bunch, Keller, TX (US); Joshua A. Bunch, Keller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/707,801

(22) Filed: Dec. 9, 2019

(65) Prior Publication Data

US 2020/0123789 A1 Apr. 23, 2020

Related U.S. Application Data

(63) Continuation of application No. 16/051,079, filed on Jul. 31, 2018, now Pat. No. 10,501,947.

(60) Provisional application No. 62/551,946, filed on Aug. 30, 2017.

(51) Int. Cl.

| | |
|---|---|
| ***E04F 21/00*** | (2006.01) |
| ***E04F 21/18*** | (2006.01) |
| ***E04F 15/02*** | (2006.01) |
| ***E04F 13/08*** | (2006.01) |
| ***E04F 21/22*** | (2006.01) |

(52) U.S. Cl.

CPC ..... *E04F 21/0092* (2013.01); *E04F 13/0892* (2013.01); *E04F 15/02022* (2013.01); *E04F 21/1877* (2013.01); *E04F 21/22* (2013.01)

(58) Field of Classification Search

CPC . E04F 21/0092; E04F 15/02022; E04F 21/22; E04F 13/0892; E04F 21/1877; E04F 21/1844

See application file for complete search history.

(56) References Cited

U.S. PATENT DOCUMENTS

| | | | |
|---|---|---|---|
| 3,185,442 | A | 5/1965 | Hemphill |
| D268,804 | S | 5/1983 | Bacon |
| D269,495 | S | 6/1983 | Finn |
| D271,559 | S | 11/1983 | Reimann et al. |
| D286,008 | S | 10/1986 | Hillinger |
| 4,688,761 | A | 8/1987 | Wilcox |
| D336,224 | S | 6/1993 | Terry |
| 5,603,195 | A | 2/1997 | Cosentino |
| D421,374 | S | 3/2000 | Montgomery |
| 6,041,473 | A | 3/2000 | Johnson |
| D481,625 | S | 11/2003 | Ellsworth |
| D590,676 | S | 4/2009 | Pickard |

(Continued)

FOREIGN PATENT DOCUMENTS

| | | |
|---|---|---|
| CA | 2892352 | 11/2016 |
| FR | 2625244 | 6/1989 |

*Primary Examiner* — Jessie T Fonseca

(74) *Attorney, Agent, or Firm* — Scott T. Griggs; Griggs Bergen LLP

(57) ABSTRACT

A wedge device for leveling tiles and a clip set for use of the same are disclosed. In one embodiment of the wedge device, the wedge device includes a body having an attachment end, a penetrating edge, a top, and a bottom. The attachment end is coupled to a backstop member and the penetrating edge is configured to penetrate the clip member. The body includes an inclined plane tapering from the attachment end to the penetrating edge. A line-of-sight opening extends along a longitudinal axis of the body to provide visibility through the body from the top to the bottom.

10 Claims, 6 Drawing Sheets

(56) References Cited

U.S. PATENT DOCUMENTS

| | | | |
|---|---|---|---|
| 7,690,080 | B1 | 4/2010 | Coffman |
| 8,429,878 | B1 | 4/2013 | Hoffman |
| D683,924 | S | 6/2013 | Woffenbarger |
| D720,588 | S | 1/2015 | Pugh |
| D731,273 | S | 6/2015 | McPeak Ford et al. |
| D760,566 | S | 7/2016 | Biec |
| 9,970,203 | B1 | 5/2018 | Abidov |
| D821,838 | S | 7/2018 | Castellanos |
| D829,532 | S | 10/2018 | Bunch et al. |
| D832,680 | S | 11/2018 | Bunch et al. |
| D850,966 | S | 6/2019 | Laurans |
| 10,501,947 | B2 | 12/2019 | Bunch et al. |
| 2008/0236094 | A1 | 10/2008 | Doda |
| 2013/0055675 | A1 | 3/2013 | Sighinolfi |
| 2014/0116001 | A1 | 5/2014 | Ghelfi |
| 2014/0298736 | A1 | 10/2014 | Bunch et al. |
| 2014/0325935 | A1 | 11/2014 | Hoffman |
| 2015/0308130 | A1 | 10/2015 | Biec |
| 2016/0090746 | A1 | 3/2016 | Sighinolfi |
| 2016/0186449 | A1 | 6/2016 | Lee |
| 2016/0222679 | A1 | 8/2016 | Bunch et al. |
| 2016/0326754 | A1 | 11/2016 | Bucsa |

WEDGE DEVICE FOR LEVELING TILES AND CLIP SET FOR USE OF SAME

PRIORITY STATEMENT & CROSS-REFERENCE TO RELATED APPLICATIONS

This application is a continuation of U.S. patent application Ser. No. 16/051,079 entitled "Wedge Device for Leveling Tiles and Clip Set for Use of Same" filed on Jul. 31, 2018 in the names of Clinton D. Bunch et al., now U.S. Pat. No. 10,501,947 issued on Dec. 10, 2019; which claims the benefit of U.S. patent application Ser. No. 62/551,946 entitled "Wedge Device for Leveling Tiles and Clip Set for Use of Same" and filed on Aug. 30, 2017, in the names of Clinton D. Bunch and Joshua A. Bunch; both of which are hereby incorporated, in their entirety, by reference for all purposes.

TECHNICAL FIELD OF THE INVENTION

This invention relates, in general, to tile installation and, in particular, to a wedge device for leveling tiles and a clip set for use of the same that properly levels tiles during the installation thereof.

BACKGROUND OF THE INVENTION

Tile has become a popular decorative and functional article for use in floors, walls, countertops, and the like. Both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. A need exists for a wedge for leveling tiles and clip set for use of the same that properly spaces tiles during the installation thereof.

SUMMARY OF THE INVENTION

It would be advantageous to achieve a device for leveling and aligning tiles and properly spacing tiles. It would also be desirable to enable a mechanical-based solution that furnishes an inexpensive tool that assists professional tile installers and do-it-yourselfers. To better address one or more of these concerns, in one aspect of the invention, a wedge device for leveling tiles and a clip set for use of the same are disclosed. In one embodiment of the wedge device, the wedge device includes a body having an attachment end, a penetrating edge, a top, and a bottom. The attachment end is coupled to a backstop member and the penetrating edge is configured to penetrate the clip member. The body includes an inclined plane tapering from the attachment end to the penetrating edge. A line-of-sight opening extends along a longitudinal axis of the body to provide visibility through the body from the top to the bottom. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
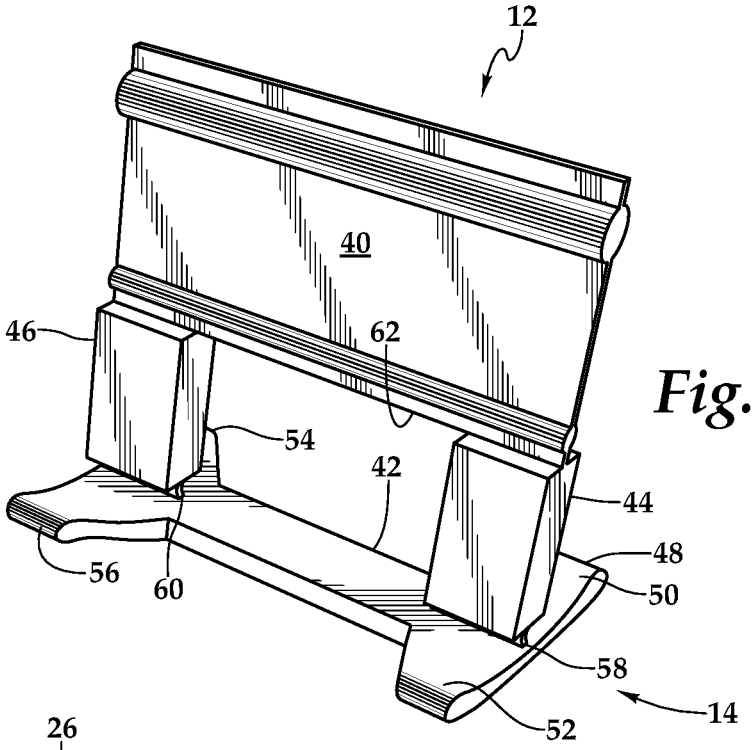
FIGS. 1A and 1B are front perspective views, when taken together, form one embodiment of a wedge device for a tile leveling device including a clip member, according to the teachings presented herein.
Figure 1B:
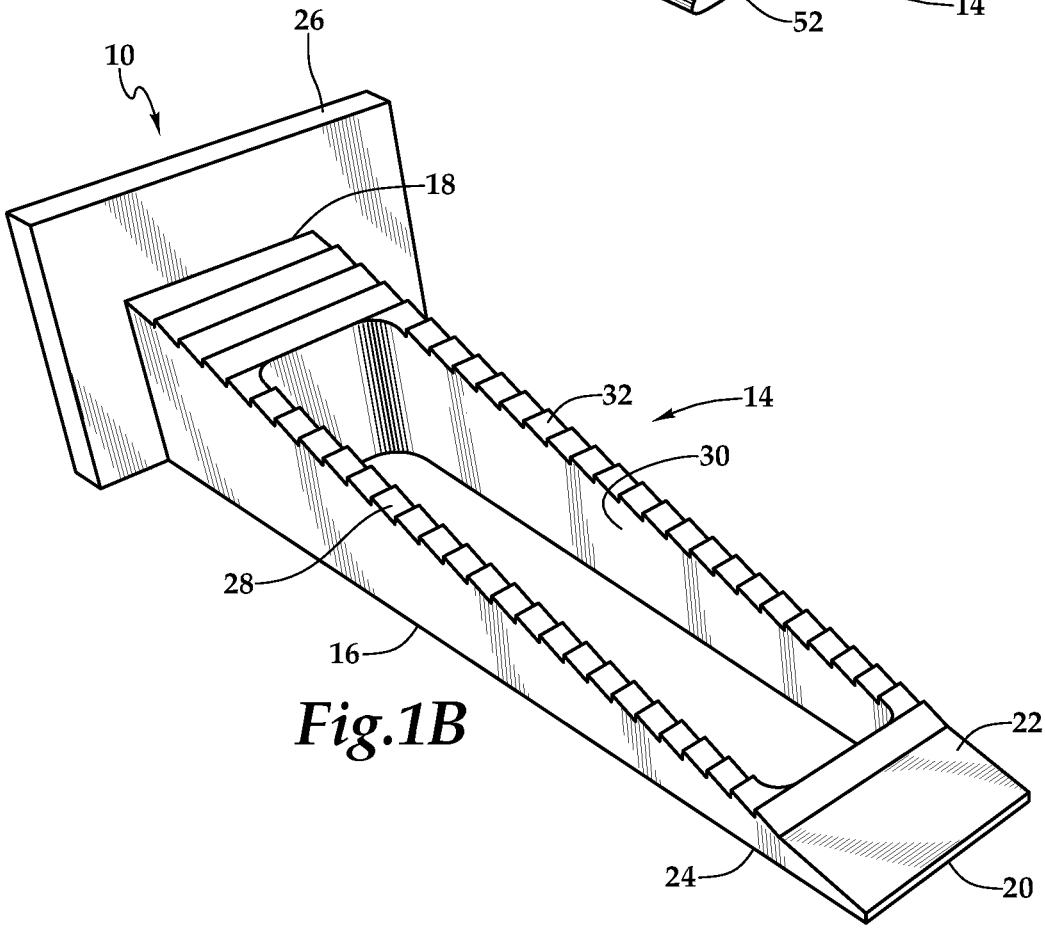

Referring initially to FIG. 1A and FIG. 1B, therein is depicted one embodiment of a wedge device schematically illustrated and generally designated 10. The wedge device 10 is utilized with a clip member 12 and the wedge device 10 and the clip member 12 are utilized, in combination, as part of a tile leveling device 14 to align and level two, three, or four tiles, for example. The wedge device 10 includes a body 16 having an attachment end 18, a penetrating edge 20, a top 22, and a bottom 24. The attachment end 18 is coupled to a backstop member 26 and the penetrating edge 20 is configured to penetrate the clip member 12. The body 16 includes an inclined plane 28 tapering from the attachment end 18 to the penetrating edge 20. A line-of-sight opening 30 extends longitudinally along the body 16. Teeth 32 are positioned along the inclined plane 28 in order to latch onto the clip member 12 as will be described in further detail hereinbelow.

In one embodiment, the clip member 12 includes an inverted U-shaped body 40 defining an open window 42 between two stems 44, 46 of the inverted U-shaped body 40. An I-shaped base 48 is orthogonally coupled to the inverted U-shaped body 40 such that four spaced bars 50, 52, 54, 56 extend transversely from the inverted U-shaped body 40. Two breakaway sections 58, 60 are defined along the respective two stems 44, 46 of the inverted U-shaped body 40. The open window 42 includes an upper edge 62. It should be appreciated that although a particular clip member is described and illustrated, the wedge device 10 presented herein may work with a variety of clip members and the clip member selected will depend on a number of manufacturing and design considerations.

Figure 2A:
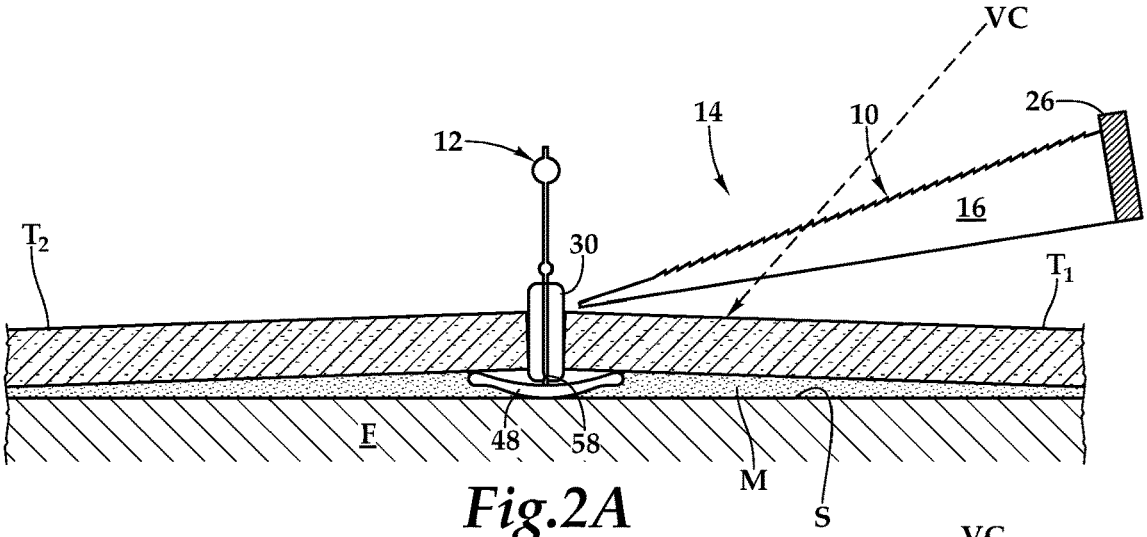
FIG. 2A is a side view, in partial cross-section, of the tile leveling device with the wedge device presented in FIG. 1 during installation of tile.
Figure 2B:
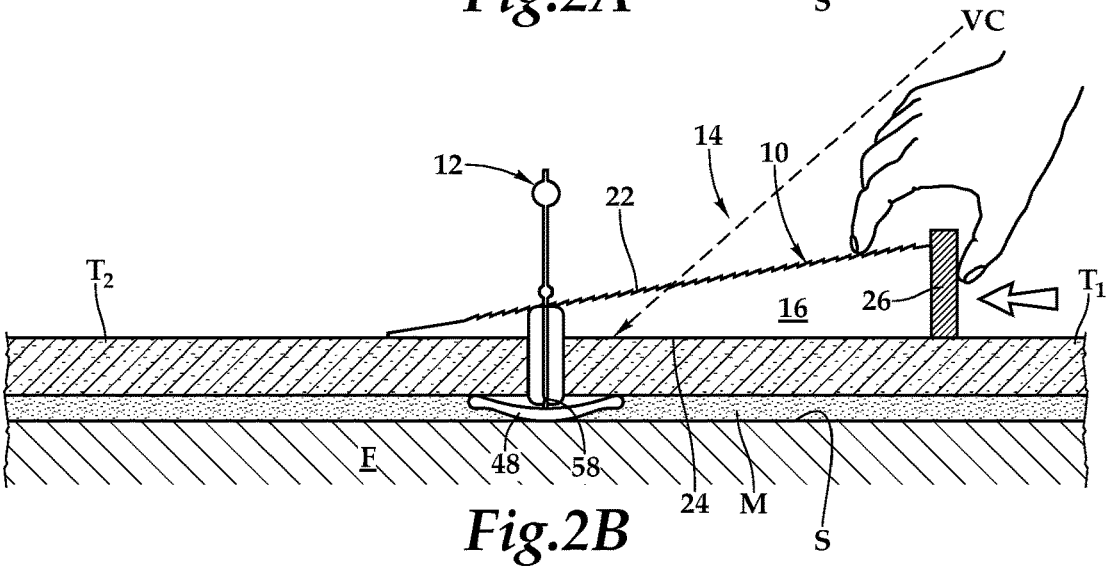
FIG. 2B is a side view, in partial cross-section, of the tile leveling device with the wedge device presented in FIG. 1 during installation of tile as the installation advances beyond FIG. 2A.
Figure 3A:
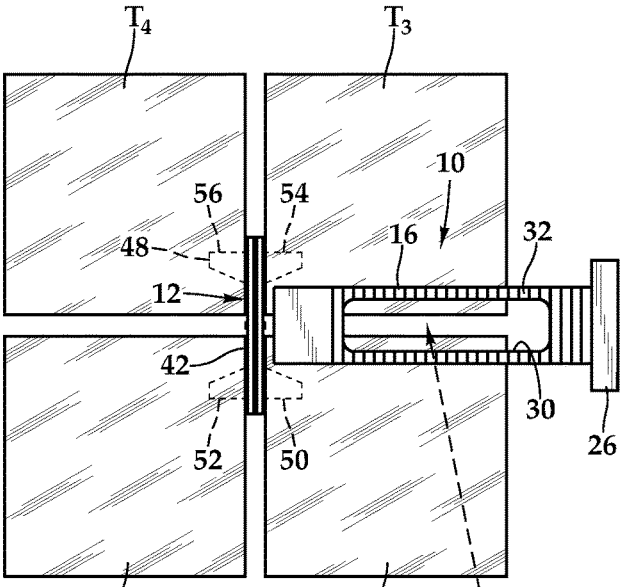
FIG. 3A is a top plan view of the tile leveling device with the wedge device presented in FIG. 2A during installation of tile.

Referring now to FIG. 2A, FIG. 2B, FIG. 3A, and FIG. 3B, in one operational implementation, the tile leveling device 14 may be used to align two, three or four tiles. As shown in FIG. 2A and FIG. 3A, the clip member 12 is positioned on a subsurface, such as a floor F having tile mortar M in space S thereon, and four tiles $T_1$, $T_2$, $T_3$, $T_4$, are placed and positioned thereon. The wedge device 10 is aligned to be inserted into the clip member 12. The backstop member 26 of the wedge device 10 provides a push area for fingers or a thumb and an enhanced sized that furnishes more leverage during use.

Figure 3B:
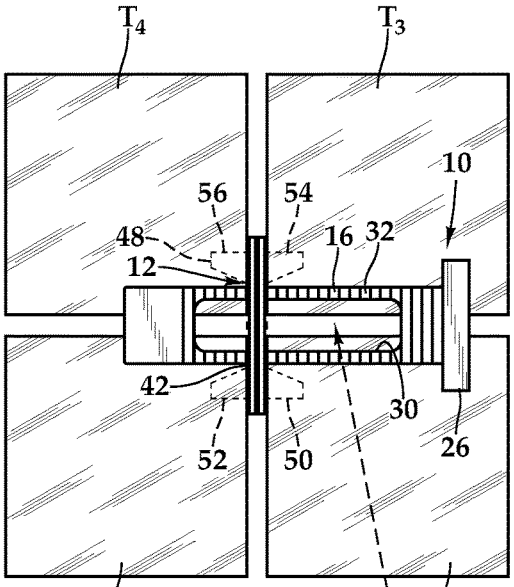
FIG. 3B is a top plan view of the tile leveling device with the wedge device presented in FIG. 2B during installation of tile.

As shown in FIG. 2B and FIG. 3B, as the wedge device 10 is inserted, the inclined plane 28 of the wedge device 10 penetrates the open window 42 contacting the upper edge 62 thereof and creating a latch. A finger or a thumb, for example, presses against the backstop member 26 of the wedge device 10 continually driving the wedge device 10 deeper into the clip member 12. As the wedge device 10 advances, the resulting force is exerted against tiles $T_1$, $T_2$, $T_3$, $T_4$ pressing the tiles $T_1$, $T_2$, $T_3$, $T_4$ against the bars 50, 52, 54, 56 wherein breakaway sections 58, 60 are located beyond the undersurfaces of the tiles $T_1$, $T_2$, $T_3$, $T_4$ in a direction away from the bars 50, 52, 54, 56. The teeth 32 prevent the wedge device 10 from slipping out of the open window 42 of the clip member 12 during penetration thereof. The application of force from the use of the tile leveling device 14 causes the tiles $T_1$, $T_2$, $T_3$, $T_4$ to be level. Following the leveling, the breakaway sections 58, 60 may be broken to remove the wedge device 10 and a portion of the clip member 12. During use, the line-of-sight opening 30 that extends longitudinally along the body 16 of the wedge device 10 provides visibility and visual contact VC through the body 16 from the top 22 to the bottom 24 of the wedge device 10. This permits a user of the wedge device 10 and the tile leveling device 14 to maintain visual contact VC with the tiles $T_1$, $T_2$, $T_3$, $T_4$ during the leveling operation, thereby improving efficiency and performance.

Figure 4:
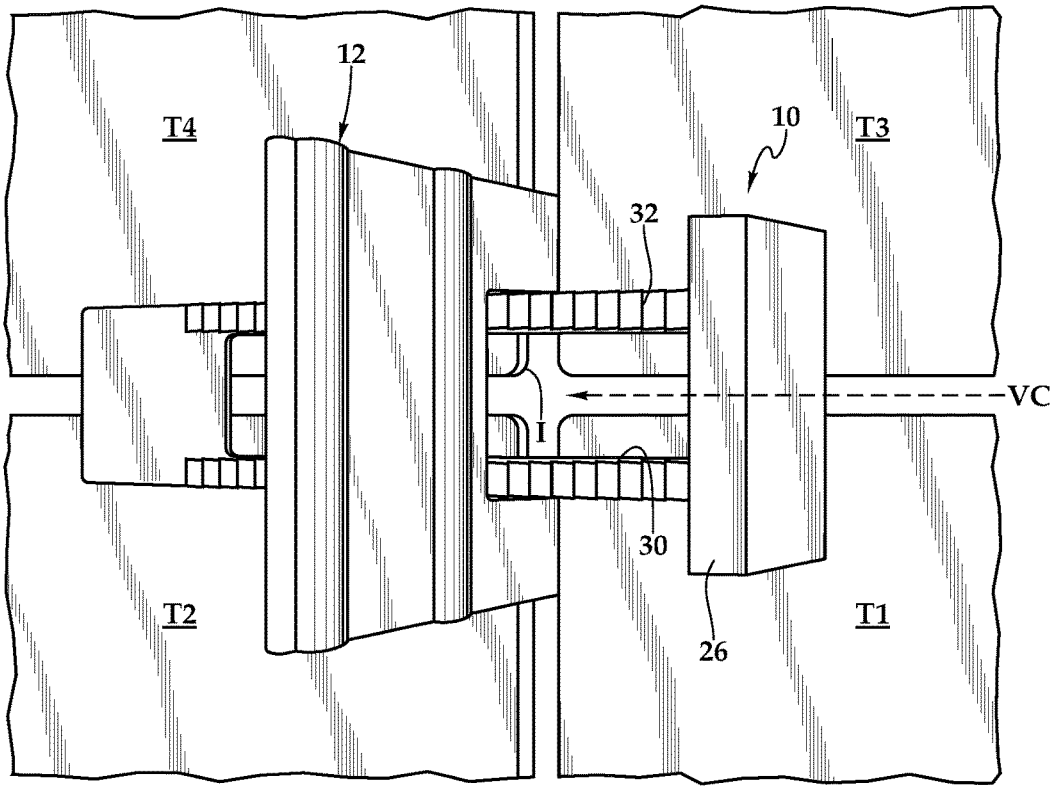
FIG. 4 is a top perspective view of the tile leveling device with the wedge device presented in FIG. 2B during installation of four tiles.
Figure 5:
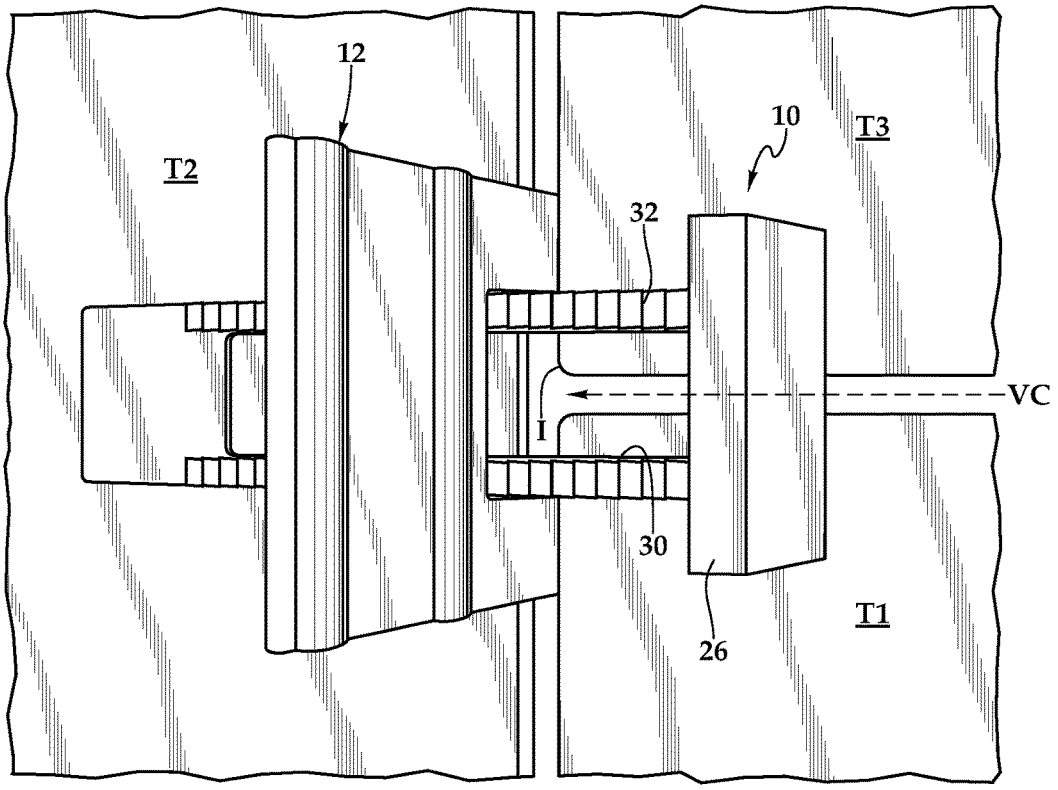
FIG. 5 is a top perspective view of the tile leveling device with the wedge device presented in FIG. 2B during installation of three tile.
Figure 6:
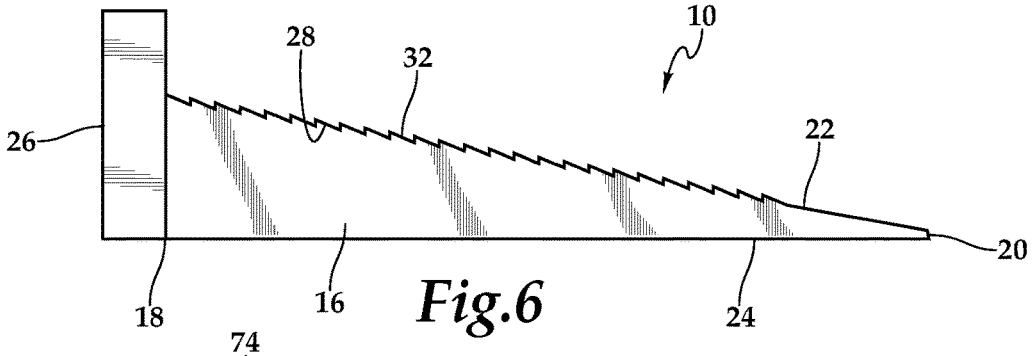
FIG. 6 is a right-side elevation view of the wedge device presented in FIG. 1, where the wedge device has left-right symmetry.
Figure 7:
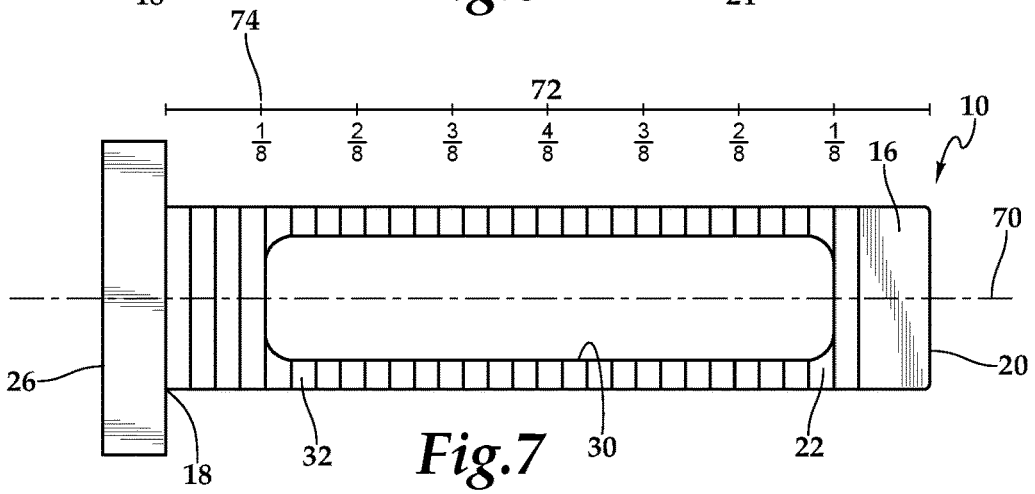
FIG. 7 is a top plan view of the wedge device presented in FIG. 1.
Figure 8:
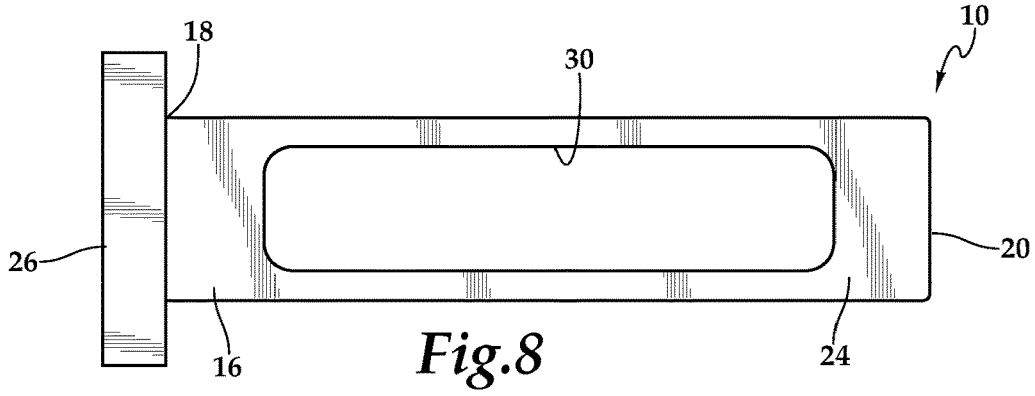
FIG. 8 is a bottom plan view of the wedge device presented in FIG. 1.

Referring now to FIG. 4 and FIG. 5, the wedge device 10 and the tile leveling device 12 presented in FIG. 2B during installation of four tiles ($T_1$, $T_2$, $T_3$, $T_4$ having an intersection I in FIG. 4) and three tiles ($T_1$, $T_2$, $T_3$ having the intersection I in FIG. 5). One of the main drawbacks of traditional wedge and clip systems is the clips cannot be placed in the intersections without interfering with one of the most important factors to tile installers; namely, visual contact with the intersections, such as intersection I in FIG. 4 and intersection I in FIG. 5. Tile installers need to be able to see the tile intersections to make sure proper alignment is achieved and spacing is even. As shown in FIG. 4 and FIG. 5, the use of the wedge device 10 having the line-of-sight opening 30 with the tile leveling device 12 creates a window providing the visual contact VC that allows the tile leveling device 12 to be placed at corners or with three or four tiles, for example. Further, as shown, the tile installer is able to maintain visual contact with the intersections I.

It is advantageous to an installer to be able to use only one tile leveling device 12 at the intersection I, instead of three or four clips, in order to save time and increase productivity. Additionally, with the use of only one tile leveling device 12 at the intersection I, costs are reduced. The window and visual contact afforded by the wedge device 10 saves time and money over existing wedge and clip systems by permitting a minimum number of components to be utilized and permitting continual visual contact at important intersections.

Referring now to FIG. 6 through FIG. 10, as previously discussed, in one embodiment, the wedge device 10 includes the body 16 having the attachment end 18, the penetrating edge 20, the top 22, and the bottom 24. The attachment end 18 is coupled to the backstop member 26 and the penetration edge 20 is configured to penetrate the clip member 12 as described above. The body 16 includes the inclined plane 28 tapering from the attachment end 18 to the penetrating edge 20. The body 16 may also include a longitudinal axis 70 from the attachment end 18 to the penetrating edge 20. The longitudinal axis 70 may have a longitudinal length 72 as indicated by the one-eighth marks 74. In one embodiment, the line-of-sight opening 30 extends along the longitudinal axis 70 and intersects the longitudinal length 72 from one-eighth (⅛) of the longitudinal length 72 measured from the attachment end 18 to one-eighth (⅛) of the longitudinal length 72 measured from the penetrating edge 20. As previously discussed, the line-of-sight opening 30 provides visibility through the body 16 from the top 22 to the bottom 24.

Figure 11:
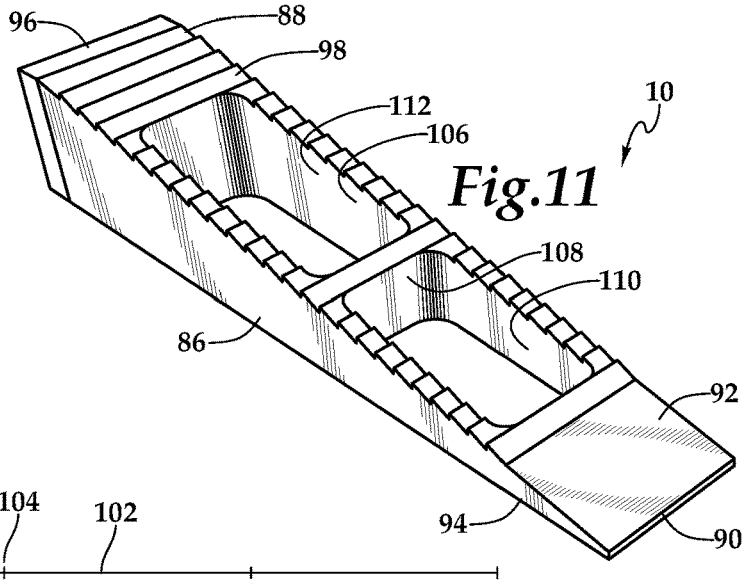
FIG. 11 is a front perspective view of another embodiment of a wedge device, according to the teachings presented herein.
Figure 12:
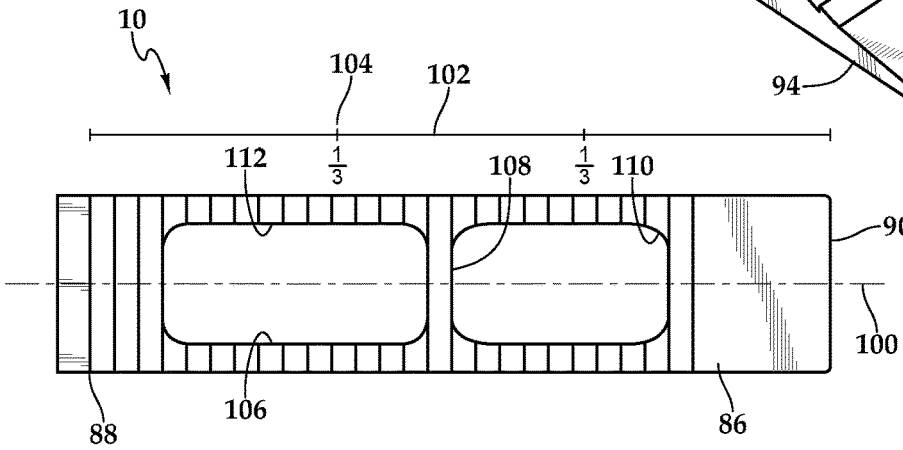
FIG. 12 is a top plan view of the wedge device presented in FIG. 11.

Referring now to FIG. 11 and FIG. 12, in another embodiment, the wedge device 10 includes a body 86 having an attachment end 88, a penetrating edge 90, a top 92, and a bottom 94. The attachment end 88 is coupled to a backstop member 96, which is slightly oversized with respect to the attachment end 88, and the penetrating edge 90 is configured to penetrate the clip member 12. The body 86 includes an inclined plane 98 tapering from the attachment end 88 to the penetrating edge 90. The body 86 may also include a longitudinal axis 100 from the attachment end 88 to the penetrating edge 90. The longitudinal axis 100 may have a longitudinal length 102, which in this embodiment includes marks 104 indicating one-third increments. A line-of-sight opening 106 extends along the longitudinal axis 100 and intersects the longitudinal length 102 from one-third (⅓) of the longitudinal length 102 measured from the attachment end 88 to one-third (⅓) of the longitudinal length 102 measured from the penetrating edge 90. As previously discussed, the line-of-sight opening 106 provides visibility through the body 86 from the top 92 to the bottom 94. A partition member 108 traverses the line-of-sight opening 106 defining opening 110 and opening 112. The openings 110 and 112 form a partition of line-of-sight opening 106.

Figure 9:
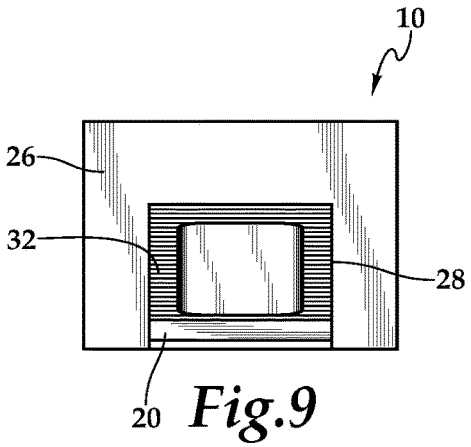
FIG. 9 is a front elevation view of the wedge device presented in FIG. 1.
Figure 10:
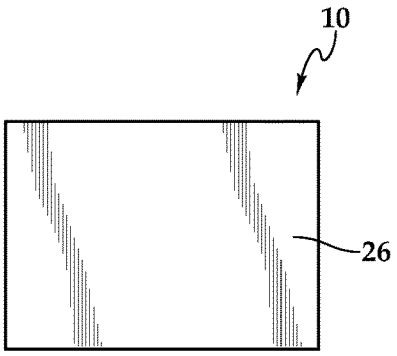
FIG. 10 is a rear elevation view of the wedge device presented in FIG. 1.

It should be appreciated that the extension of the line-of-sight opening 106 may vary from application to application. By way of example, as illustrated in FIGS. 9 and 10, the line-of sight opening 106 may extend along the longitudinal axis 100 and intersect the longitudinal length 102 from one-eighth of the longitudinal length 102 measured from the attachment end 88 to one-eighth (⅛) of the longitudinal length 102 measured from the penetrating edge 90. By way of further example, the line-of sight opening 106 may extend along the longitudinal axis 100 and intersect the longitudinal length 102 from one-sixth (⅙) or one-quarter (¼), for example, of the longitudinal length 102 measured from the attachment end 88 to a respective one-sixth (⅙) or one-quarter (¼), for example, of the longitudinal length 102 measured from the penetrating edge 90.

Figure 13:
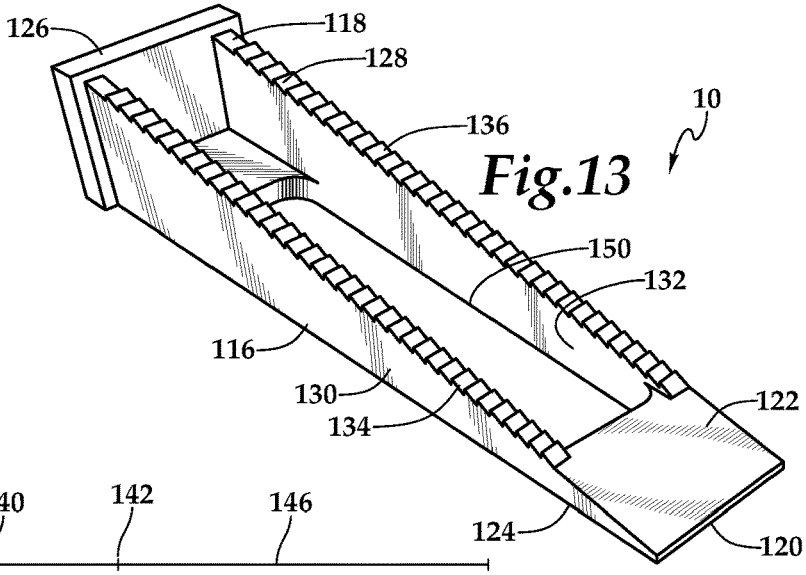
FIG. 13 is a front perspective view of another embodiment of a wedge device, according to the teachings presented herein.
Figure 14:
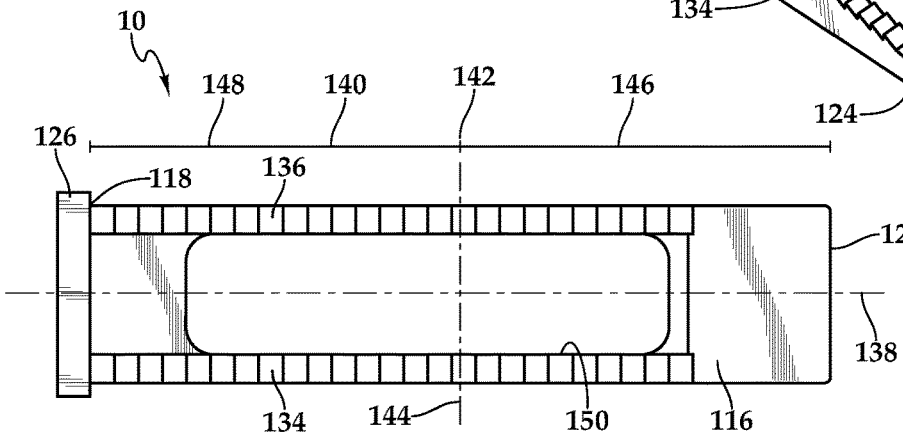
FIG. 14 is a top plan view of the wedge device presented in FIG. 13.

Referring now to FIG. 13 and FIG. 14, in another embodiment, the wedge device 10 includes a body 116 having an attachment end 118, a penetrating edge 120, a top 122, and a bottom 124. The attachment end 118 is coupled to a backstop member 126, which is substantially flush with the attachment end 118, and the penetrating edge 120 is configured to penetrate the clip member 12. The body 116 includes an inclined plane 128 tapering from the attachment end 118 to the penetrating edge 120. Wall members 130, 132 secure the inclined plane 128, which may include inclined plane member 134 and inclined plane member 136, to the body 116. The body 116 may also include a longitudinal axis 138 from the attachment end 118 to the penetrating edge 120. The longitudinal axis 138 may include a longitudinal length 140 having a midpoint 142 and a mediolateral axis 144 bisecting the midpoint 142 creating a longitudinal length segment 146 and a longitudinal length segment 148. A line-of-sight opening 150 extends along the longitudinal axis 138 and intersects the longitudinal length segment 146 and the longitudinal length segment 148. As previously discussed, the line-of-sight opening 150 provides visibility through the body 116 from the top 122 to the bottom 124.

Figure 15:
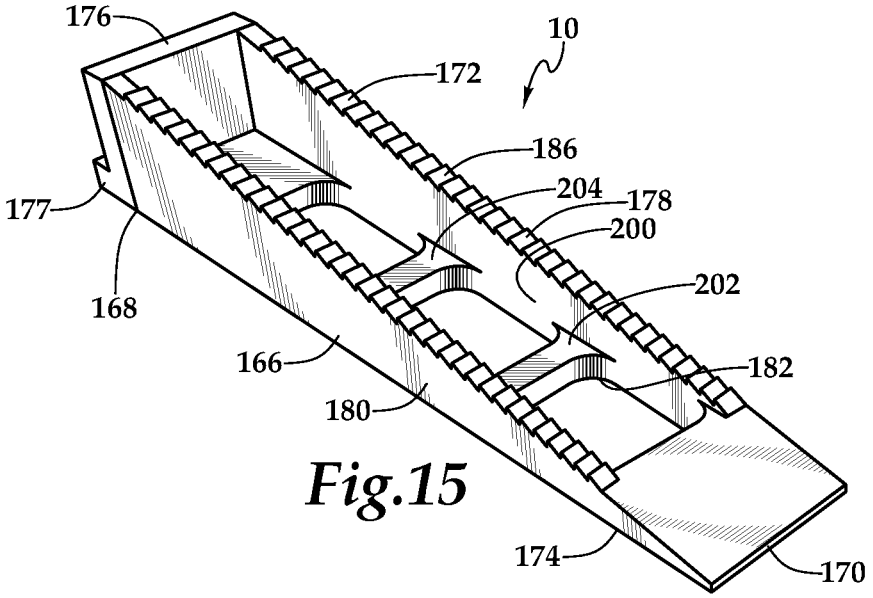
FIG. 15 is a front perspective view of another embodiment of a wedge device, according to the teachings presented herein.
Figure 16:
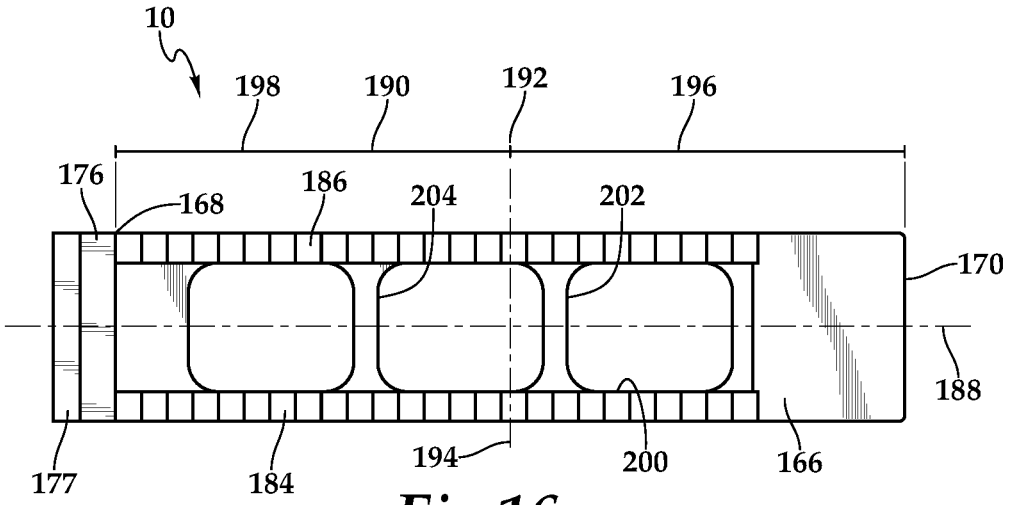
FIG. 16 is a top plan view of the wedge device presented in FIG. 15.

Referring now to FIG. 15 and FIG. 16, in another embodiment, the wedge device 10 includes a body 166 having an attachment end 168, a penetrating edge 170, a top 172, and a bottom 174. The attachment end 168 is coupled to a backstop member 176 and the penetrating edge 170 is configured to penetrate the clip member 12. The backstop member 176 may include a flange 177 that extends therefrom to provide a contact surface for tool engagement. The body 166 includes an inclined plane 178 tapering from the attachment end 168 to the penetrating edge 170. Wall members 180, 182 secure the inclined plane 178, which may include inclined plane member 184 and inclined plane member 186, to the body 166. The body 166 may also include a longitudinal axis 188 from the attachment end 168 to the penetrating edge 170. The longitudinal axis 188 may include a longitudinal length 190 having a midpoint 192 and a mediolateral axis 194 bisecting the midpoint 192 creating a longitudinal length segment 196 and a longitudinal length segment 198. A line-of-sight opening 200 extends along the longitudinal axis 188 and intersects the longitudinal length segment 196 and the longitudinal length segment 198. As previously discussed, the line-of-sight opening 200 provides visibility through the body 166 from the top 172 to the bottom 174. Crossbar members 202, 204 traverse the line-of-sight opening 200 within the body 166.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A wedge device for a tile leveling device including a clip member, the wedge device comprising:

a backstop member;

a body having an attachment end, a penetrating edge, a top, and a bottom, the attachment end being coupled to the backstop member, the penetrating edge being configured to penetrate the clip member, the penetrating edge being continuous the entire width of the body;

the body including an inclined plane tapering from the attachment end to the penetrating edge;

the body including a longitudinal axis from the attachment end to the penetrating edge, the longitudinal axis having a longitudinal length; and a line-of-sight opening extending along the longitudinal axis and intersecting the longitudinal length, the line-of-sight opening providing visibility through the body from the top to the bottom, the line-of-sight opening sized to provide a user of the wedge device visual contact with tiles during a leveling operation.

2. The wedge device as recited in claim 1, further comprising teeth disposed along the inclined plane, the teeth latch onto an upper edge of an insertion space in the clip member.

3. The wedge device as recited in claim 1, further comprising a partition member traversing the line-of-sight opening.

4. The wedge device as recited in claim 1, further comprising a crossbar member traversing the line-of-sight opening.

5. The wedge device as recited in claim 1, wherein the body including the inclined plane tapering from the attachment end to the penetrating edge further comprises a wall member coupled to the body.

6. The wedge device as recited in claim 1, wherein the line-of-sight opening intersects the inclined plane.

7. The wedge device as recited in claim 1, wherein the line-of-sight opening is subjacent to the inclined plane.

8. The wedge device as recited in claim 1, wherein the backstop member has a larger surface area than the attachment end.

9. A wedge device for a tile leveling device including a clip member, the wedge device comprising:

a backstop member;

a body having an attachment end, a penetrating edge, a top, and a bottom, the attachment end being coupled to the backstop member, the penetrating edge being configured to penetrate the clip member, the penetrating edge being continuous the entire width of the body;

the body including an inclined plane tapering from the attachment end to the penetrating edge;

the body including a longitudinal axis from the attachment end to the penetrating edge, the longitudinal axis having a longitudinal length; and a line-of-sight opening extending along the longitudinal axis and intersecting the longitudinal length, the line-of-sight opening sized to provide a user of the wedge device visual contact with tiles during a leveling operation.

10. A wedge device for a tile leveling device including a clip member, the wedge device comprising:

a backstop member;

a body having an attachment end, a penetrating edge, a top, and a bottom, the attachment end being coupled to the backstop member, the penetrating edge being configured to penetrate the clip member, the penetrating edge being continuous the entire width of the body;

the body including an inclined plane tapering from the attachment end to the penetrating edge;

the body including a longitudinal axis from the attachment end to the penetrating edge, the longitudinal axis having a longitudinal length; and a line-of-sight opening extending along the longitudinal axis and intersecting the longitudinal length between the attachment edge and the penetrating edge, the line-of-sight opening providing visibility through the body from the top to the bottom, the line-of-sight opening sized to provide a user of the wedge device visual contact with tiles during a leveling operation.

* * * * *